US009924268B1

(12) United States Patent
Tsao et al.

(10) Patent No.: US 9,924,268 B1
(45) Date of Patent: Mar. 20, 2018

(54) SIGNAL PROCESSING SYSTEM AND A METHOD

(71) Applicant: LYRA SEMICONDUCTOR INCORPORATED, Hsinchu County (TW)

(72) Inventors: Hung-Chang Tsao, Hsinchu County (TW); Chia-Te Hsu, Hsinchu County (TW)

(73) Assignee: LYRA SEMICONDUCTOR INCORPORATED, Hsinchu County (TW)

( * ) Notice: Subject to any disclaimer, the term of this patent is extended or adjusted under 35 U.S.C. 154(b) by 0 days.

(21) Appl. No.: 15/475,361

(22) Filed: Mar. 31, 2017

(30) Foreign Application Priority Data

Jan. 23, 2017 (TW) ..... 106102326 A

(51) Int. Cl.

| | |
|---|---|
| ***H04R 3/04*** | (2006.01) |
| ***H04R 29/00*** | (2006.01) |
| ***H04R 3/00*** | (2006.01) |
| ***H04R 1/10*** | (2006.01) |

(52) U.S. Cl.
CPC ..... *H04R 3/04* (2013.01); *H04R 1/1041* (2013.01); *H04R 3/007* (2013.01); *H04R 29/001* (2013.01)

(58) Field of Classification Search
CPC ..... H04R 1/1083; H04R 5/033; H04R 3/12; H04R 1/1075; H04R 3/04
See application file for complete search history.

*Primary Examiner* — Mohammad Islam
(74) *Attorney, Agent, or Firm* — Lin & Associates Intellectual Property, Inc.

(57) ABSTRACT

A signal processing system and a method thereof are disclosed, using a differential amplifier to extract the sensed signals associated with the headphones wear status generated by the diaphragm of the headphone and push back to the sense ADC for digitization. Because the differential amplifier is non-ideal, certain residual music signal will exist. To exclude residual music signal for subsequent processing, a temporary memory is provided to match and synchronize the original playback signal retainment and the round-trip delay of external signal. The round-trip delay is computed to adjust the depth and clock speed of the buffer/FIFO of the temporary memory to, after synchronized with the total external propagation delay, eliminate residual music signal in a function block in order to separate the sense signal of the headphone driver unit diaphragm displacement and use the extracted sense signal for subsequent analysis and auto-control and/or signal compensation reference source.

5 Claims, 15 Drawing Sheets

SIGNAL PROCESSING SYSTEM AND A METHOD

CROSS-REFERENCE TO RELATED APPLICATION

The present application is based on, and claims priority form, Taiwan Patent Application No. 106102326, filed Jan. 23, 2017, the disclosure of which is hereby incorporated by reference herein in its entirety.

TECHNICAL FIELD

The technical field generally relates to a signal processing system and method, and in particular, to a signal processing system and method, applicable to an environment of signal separation application with a headphone driver unit diaphragm used as a sensor, by analyzing the headphone wear status, extracting the sensed signals associated with the headphones wear status generated by the diaphragm of the headphone and use the extracted sense signal for subsequent analysis and auto-control and/or signal compensation reference source.

BACKGROUND

In known headphone technology, the driver units of various types of headphones outputting sound wave also incurs an electrical output with respect to the pressure resist changes on the front and rear cavities of the diaphragm, for example, donned, doffed, or vibration (such as, fingertip tapping the headphone case). In other words, because of the diaphragm displacement caused by force resulting in a change in magnetic field, a current signal is generated. However, at present, the generated current signal is viewed as additional signal other than the audio playback signal, and is not used or applied.

For the current usage status detection of headphones, US Publication No. 20150281825 A1 disclosed a headphone on-head detection using differential signal measurement, which described how additional microphones (element 114/124 in FIG. 1) are used as a sensor, but the current signal generated by the displacement of the headphone driver unit diaphragm is not utilize or applied.

Taiwan Patent No. 1522902 disclosed an "Electronic Device and Headphone Sensing Method", applicable to an electronic device having a headphone jack, which includes a conductive plug for detecting whether or not the headphone jack is inserted with a speaker device; when the conductive plug is inserted into the headphone jack, the microphone contact point of the conductive plug records to generate a recording result and determines whether an audio signal is included in the recording result; and when the recording result includes the audio signal, the speaker device is determined to provide a microphone function.

Taiwan Patent No. 1316401 disclosed a "Headphone ECG Measurement System", providing a headphone-sensing heart-rate measurement system for convenient, comfort and non-invasive ECG measurement. The ECG measurement system comprises an ECG signal analysis device and a headphone sensing device. The ECG signal analysis device comprises an amplifier module, a micro controller, a display, a radio module and a shell with conductive contacts. The headphone sensing device includes a headphone and an electrode arranged in the headphone, and electrically connectable to a user for collecting the weak ECG signal of the user's head, to form a basic circuit with the shell having conductive contacts and the user's body surface contacting the electrode for collecting the ECG signals.

Taiwan Patent No. 201422204 disclosed "Acquiring physiologic measurements using a sensor at the ear", providing a device and method for acquiring one or more physiological measurements associated with a user using a sensor located at the ear. One or more different types of sensors are configured to engage a user's ear; wherein the sensors are contained in one or both of ear-pieces of the headphones to capture physiological parameters. A portable device is configured to communicate with the sensors to receive physiological parameters and provide control signals to the sensors or other elements in the headphone. And the portable device determines physiological measurements corresponding to the received physiological parameters, and the portable device is also configured to provide a user interface to interact with the user regarding the physiological measurements.

Therefore, the issues need to be addressed include how to uses a headphone driver unit diaphragm used as a sensor, by analyzing the headphone wear status to use the electric output signal generated by the pressure resist changes on the front and rear cavities of the diaphragm; in other words, a current signal generated because of the diaphragm displacement caused by force resulting in a change in magnetic field; and how to extract the sense signal generated by the diaphragm passively sensed during headphone playback without using additional microphone element and use the extracted sense signal for subsequent analysis and auto-control and/or signal compensation reference source.

SUMMARY

An object of the present invention is to provide a signal processing system and method, for analyzing headphone wear status of a user with a headphone driver unit diaphragm as a sensor without increasing a headphone material (BOM), to extract the sense signal generated by the headphone driver unit diaphragm passively and using the extracted sense signal for subsequent analysis and auto-control and/or signal compensation reference source.

Another object of the present invention is to provide a signal processing system and method, applicable to an environment of signal separation application with a headphone driver unit diaphragm used as a sensor, by analyzing the headphone wear status. The signal processing system of the present invention uses a differential amplifier to extract the sensed signals associated with the headphones wear status generated by the diaphragm of the headphone and push back to the sense ADC for digitization. Because the differential amplifier is non-ideal (CMRR is not no limit), a certain percentage of residual music signal will exist. To exclude residual music signal for subsequent processing, an additional temporary memory is provided to match and synchronize the original playback signal retainment and the round-trip delay of external signal. The round-trip delay is computed according to the sample clock of the audio DAC and sense ADC and the type of selected filter, to adjust the depth and clock speed of the buffer/FIFO of the temporary memory so as to, after synchronized with the total external propagation delay, eliminate residual music signal in a function block in order to separate the sense signal of the headphone driver unit diaphragm displacement and use the extracted sense signal for subsequent analysis and auto-control and/or signal compensation reference source.

Yet another object of the present invention is to provide a signal processing system and method, applicable to an environment of signal separation application with a headphone driver unit diaphragm used as a sensor, by analyzing the headphone wear status to save the additional cable for headphone sensor to sense the donned and doffed status. For example, when the headphone is a status of being removed from one ear, the playback of music is automatically paused to facilitate the conversation; in a status of being removed from both ears, the playback/cellphone is automatically in a sleep mode; when the headphone is worn in one ear, the phone is automatically answered; and when wearing on two ears without in-coming phone call, the music paused earlier is automatically resumed.

Yet another object of the present invention is to provide a signal processing system and method, applicable to an environment of signal separation application with a headphone driver unit diaphragm used as a sensor, by analyzing the headphone wear status; without adding additional headphone material (BOM), a tapping on the headphone shell can be used to replace button interface, such as, for play/pause/answer/hang-up/skip song/and volume adjustment.

Yet another object of the present invention is to provide a signal processing system and method, applicable to an environment of signal separation application with a headphone driver unit diaphragm used as a sensor, by analyzing the headphone wear status; without adding additional headphone material (BOM), a back electromotive force generated by the overdrive displacement of the headphone driver unit diaphragm can be detected in real-time to compensate the motion distortion of the driver unit diaphragm and improve the audio quality of low-cost headphone driver unit and reduce the output to protect the driver unit from burning caused by excessive back electromotive force.

To achieve the aforementioned objects, the present invention provides a signal processing system, including: a power amplifier, a differential amplifier, an audio digital-to-analog converter (DAC), a sense analog-to-digital converter (ADC), a temporary memory and a function block.

The audio DAC: an original music digital streaming data is converted by the audio DAC to an analog output.

The power amplifier: when the original music digital stream data is converted by the audio DAC to the analog output, the analog output is sent to the power amplifier for outputting the original music input signal as the analog signal to the headphone unit; moreover, a sense signal caused by the displacement of the diaphragm when the diaphragm of the headphone unit is induced by the external force and the non-ideal motion will be pushed back to the output end of the power amplifier.

The differential amplifier: the output end of the power amplifier is connected to an input end of the differential amplifier and the output of the audio DAC is connected to the other input end.

The sense ADC: the sense ADC is connected to the differential amplifier, and the sense signal generated by the diaphragm is extracted by the differential amplifier and pushed back to the sense ADC for digitization.

The temporary memory: because of the non-ideality of the differential amplifier (CMRR is not without upper limit), there will still be a certain percentage of the residual original music signal, and to eliminate the residual original music signal for subsequent processing, the temporary memory is additionally disposed to match and synchronize the original signal residual with a round-trip delay of the external signal starting from the audio DAC, through the power amplifier, the headphone unit, the differential amplifier to the sense ADC, the round-trip delay is calculated according to the sample clock frequencies of the audio DAC and the sense ADC, and the type of the filter to adjust and set the depth and the clock of the buffer/FIFO of the temporary memory to synchronize with the external propagation total delay.

The function block: the function block is a headphone unit diaphragm displacement extraction module, for extracting the sensing signal generated by the headphone unit diaphragm displacement; after adjusting and setting the depth and the clock of the buffer/FIFO of the temporary memory to synchronize with the external propagation total delay, the function block performs clearing residual music signals to separate the sensing signal of the headphone unit diaphragm displacement and extracting the sensing signal for subsequent analysis and reference source of automatic control and/or signal compensation.

Wherein, when matching and synchronizing the original signal residual with a round-trip delay of the external signal starting from the audio DAC, through the power amplifier, the headphone unit, the differential amplifier to the sense ADC:

1. In the audio DAC: the internal over sample filter has a fixed delay linked to the sample clock, according to the features and specifications of finite impulse response (FIR) filter and the infinite impulse response (IIR) filter, the fixed delay is generally between tens of microsecond (ρs) and a few millisecond (ms).

2. During the trip from the power amplifier to the headphone unit to the differential amplifier: the delay is mainly the parasitic and compensation RC delay of the linear amplifier, generally a few hundreds of nanoseconds.

3. In the sense ADC: the delay is the internal command input coupler (CIC) filter iterative computation delay, which is the multiplication of the over sample rate and the over sample clock, generally tens of ρs.

The above three delays can be described by formula. After computing the round-trip delay based on the sample clock frequencies of the audio DAC and the sense ADC, and the type of the filter used, and the result is used for adjusting and setting the depth and the clock of the buffer/FIFO of the temporary memory to synchronize with the external propagation total delay, the function block performs clearing residual music signals to separate the sensing signal of the headphone unit diaphragm displacement and extracting the sensing signal for subsequent analysis and reference source of automatic control and/or signal compensation.

Moreover, depending on actual needs, the signal processing system of the present invention further comprises a first processing unit, wherein the first processing unit is for outputting the identified signal to the main controller, and the sensing signal of the headphone unit diaphragm extracted by the function block is transmitted to the first processing unit for motion signal identification to determine the usage status of the headphone unit by the user, for example, putting on the headphone, taking of the headphone, or filter tapping the headphone shell. The first processing unit can output the identified signal to the main controller for human-machine interaction application.

Alternatively, in actual application, the signal processing system of the present invention may further comprise a second processing unit, wherein the second processing unit is for signal compensation; the music related signals of the sensing signal of the headphone unit diaphragm extracted and separated by the block function is sent to the second processing unit for low-pass filtering, and then phase-inversed and added to the original music digital stream data to compensate the bass distortion of the headphone unit.

In the process of the signal processing system executing signal processing method, the first step is to receive the sensing signal; using the headphone unit diaphragm as a sensor, when the headphone unit diaphragm connected to the signal processing system of the present invention shows diaphragm displacement caused by the external force or non-ideal motion, a sensing signal is generated and pushed back to the output end of the power amplifier of the signal processing system.

Then, the signal extraction and processing is performed; wherein the sensing signal of the headphone unit passively induced is extracted while the headphone unit playing the audio, and the extracted sensing signal is used as the reference source for subsequent analysis and automatic control.

Accordingly, during performing signal extraction, after the sensing signal generated by the diaphragm displacement of the headphone unit diaphragm caused by the external force and non-ideal motion is pushed back to the output end of the power amplifier, the differential amplifier is used to extract the sensing signal generated by the diaphragm and pushed back to the sense ADC for digitization since the output end of the power amplifier is connected to an input end of the differential amplifier, the output end of the audio DAC is connected to the other input end of the differential amplifier, the sense ADC is connected to the differential amplifier; because of the non-ideality of the differential amplifier (CMRR is not without upper limit), there will still be a certain percentage of the residual original music signal, and to eliminate the residual original music signal for subsequent processing, the temporary memory is additionally disposed to match and synchronize the original signal residual with a round-trip delay of the external signal starting from the audio DAC, through the power amplifier, the headphone unit, the differential amplifier to the sense ADC.

Accordingly, the round-trip delay is calculated according to the sample clock frequencies of the audio DAC and the sense ADC, and the type of the filter to adjust and set the depth and the clock of the buffer/FIFO of the temporary memory to synchronize with the external propagation total delay; then, after adjusting and setting the depth and the clock of the buffer/FIFO of the temporary memory to synchronize with the external propagation total delay, the function block performs clearing residual music signals to separate the sensing signal of the headphone unit diaphragm displacement and extracting the sensing signal for subsequent analysis and reference source of automatic control and/or signal compensation.

Wherein, when matching and synchronizing the original signal residual with a round-trip delay of the external signal starting from the audio DAC, through the power amplifier, the headphone unit, the differential amplifier to the sense ADC:

1. In the audio DAC: the internal over sample filter has a fixed delay linked to the sample clock, according to the features and specifications of finite impulse response (FIR) filter and the infinite impulse response (IIR) filter, the fixed delay is generally between tens of microsecond (μs) and a few millisecond (ms).

2. During the trip from the power amplifier to the headphone unit to the differential amplifier: the delay is mainly the parasitic and compensation RC delay of the linear amplifier, generally a few hundreds of nanoseconds.

3. In the sense ADC: the delay is the internal command input coupler (CIC) filter iterative computation delay, which is the multiplication of the over sample rate and the over sample clock, generally tens of μs.

Moreover, depending on actual needs, the signal processing method executed by the signal processing system of the present invention further comprises a step of analyzing control motion, wherein the first processing unit is for outputting the identified signal to the main controller, and the sensing signal of the headphone unit diaphragm extracted by the function block is transmitted to a first processing unit for motion signal identification to determine the usage status of the headphone unit by the user, for example, putting on the headphone, taking of the headphone, or filter tapping the headphone shell. The first processing unit can output the identified signal to the main controller for human-machine interaction application. Alternatively, the music related signals of the sensing signal of the headphone unit diaphragm extracted and separated by the block function is sent to a second processing unit for low-pass filtering, and then phase-inversed and added to the original music digital stream data to compensate the bass distortion of the headphone unit.

The foregoing will become better understood from a careful reading of a detailed description provided herein below with appropriate reference to the accompanying drawings.

BRIEF DESCRIPTION OF THE DRAWINGS

The embodiments can be understood in more detail by reading the subsequent detailed description in conjunction with the examples and references made to the accompanying drawings, wherein:

FIG. 10-1 shows a schematic view of sensing signal output of the headphone unit diaphragm when the user putting on the earmuff headphone of FIG. 7;

FIG. 10-2 shows a schematic view of sensing signal output of the headphone unit diaphragm when the user taking off the earmuff headphone of FIG. 7;

FIG. 10-3 shows a schematic view of sensing signal output of the headphone unit diaphragm when the user putting on the in-ear headphone of FIG. 7;

FIG. 10-4 shows a schematic view of sensing signal output of the headphone unit diaphragm when the user taking off the in-ear headphone of FIG. 7;

DETAILED DESCRIPTION OF THE DISCLOSED EMBODIMENTS

Figure 1:
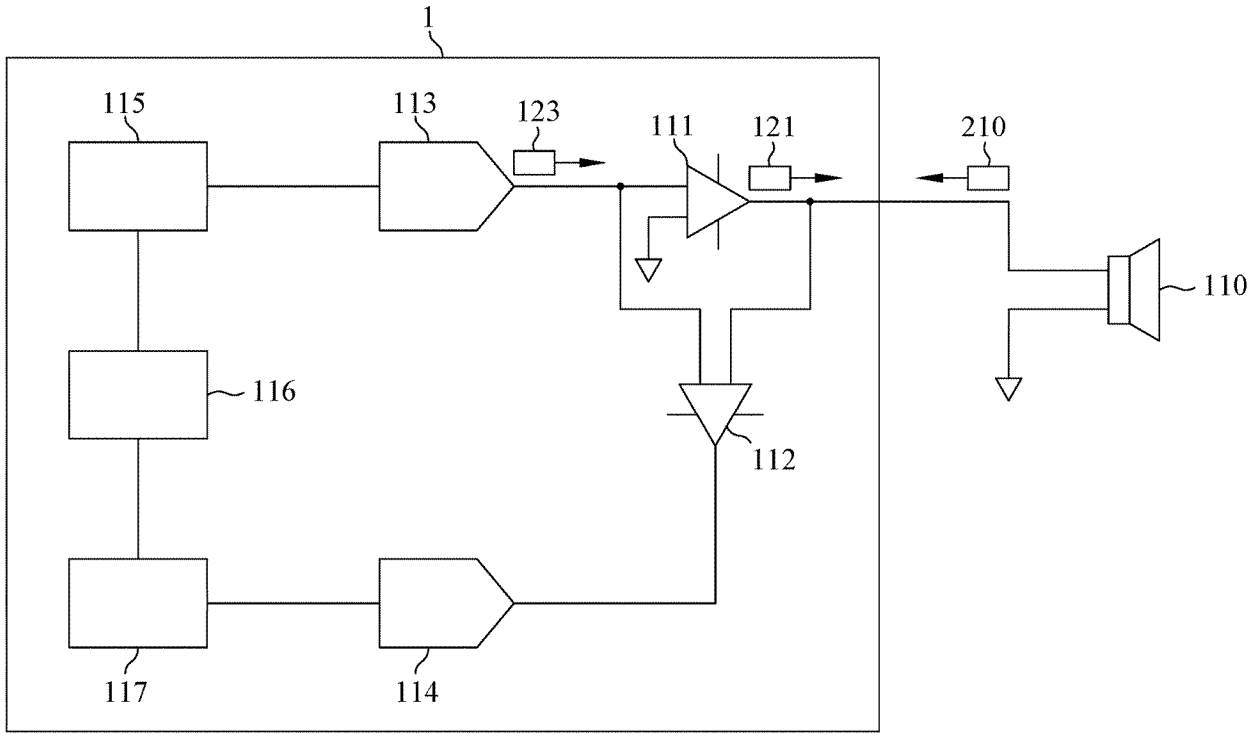
FIG. 1 shows a schematic view of a signal processing system and operation in collaboration with a headphone unit in accordance with an exemplary embodiment.

In the following detailed description, for purpose of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

FIG. 1 shows a schematic view of the signal processing system and operation in collaboration with a headphone unit according to an exemplary embodiment. As shown in FIG. 1, the signal processing system 1 comprises at least a power amplifier 111, a differential amplifier 112, an audio digital-to-analog converter (DAC) 113, a sense analog-to-digital converter (ADC) 114, a temporary memory 116 and a function block 117.

The audio DAC 113: an original music digital streaming data 115 is converted by the audio DAC 113 to an analog output 123.

The power amplifier 111: when the original music digital stream data 115 is converted by the audio DAC 113 to the analog output 123, the analog output 123 is sent to the power amplifier 111 for outputting the original music input signal 121 as the analog signal to the headphone unit 110 connected to the power amplifier 111; moreover, a sense signal 210 caused by the displacement of the diaphragm (not shown) when the diaphragm of the headphone unit 110 is induced by the external force and the non-ideal motion will be pushed back to the output end of the power amplifier 111.

The differential amplifier 112: the output end of the power amplifier 111 is connected to an input end of the differential amplifier 112 and the output of the audio DAC 113 is connected to the other input end of the differential amplifier 112.

The sense ADC 114: the sense ADC 114 is connected to the output of the differential amplifier 112, and the sense signal 210 generated by the diaphragm is extracted by the differential amplifier 112 and pushed back to the sense ADC 114 for digitization.

The temporary memory 116: because of the non-ideality of the differential amplifier 112 (CMRR is not without upper limit), there will still be a certain percentage of the residual original music signal, and to eliminate the residual original music signal for subsequent processing, the temporary memory 116 is additionally disposed to match and synchronize the original signal residual (music digital stream data 115) with a round-trip delay of the external signal starting from the audio DAC 113, through the power amplifier 111, the headphone unit 110, the differential amplifier 112 to the sense ADC 114, the round-trip delay is calculated according to the sample clock frequencies of the audio DAC 113 and the sense ADC 114, and the type of the filter to adjust and set the depth and the clock of the buffer/FIFO of the temporary memory 116 to synchronize with the external propagation total delay.

The function block 117: the function block 117 is a headphone unit diaphragm displacement extraction module, for extracting the sensing signal generated by the headphone unit 110 diaphragm displacement; after adjusting and setting the depth and the clock of the buffer/FIFO of the temporary memory 116 to synchronize with the external propagation total delay, the function block 117 performs clearing residual music signals to separate the sensing signal 210 of the headphone unit 110 diaphragm displacement and extracting the sensing signal 210 for subsequent analysis and reference source of automatic control and/or signal compensation.

Wherein, when matching and synchronizing the original signal residual with a round-trip delay of the external signal starting from the audio DAC 113, through the power amplifier 111, the headphone unit 110, the differential amplifier 112 to the sense ADC 114:

1. In the audio DAC 113: the internal over sample filter has a fixed delay linked to the sample clock, according to the features and specifications of finite impulse response (FIR) filter and the infinite impulse response (IIR) filter, the fixed delay is generally between tens of microsecond (μs) and a few millisecond (ms).

2. During the trip from the power amplifier 111 to the headphone unit 110 to the differential amplifier 112: the delay is mainly the parasitic and compensation RC delay of the linear amplifier, generally a few hundreds of nanoseconds.

3. In the sense ADC 114: the delay is the internal command input coupler (CIC) filter iterative computation delay, which is the multiplication of the over sample rate and the over sample clock, generally tens of μs.

The above three delays can be described by formula. After computing the round-trip delay based on the sample clock frequencies of the audio DAC 113 and the sense ADC 114, and the type of the filter used, and the result is used for adjusting and setting the depth and the clock of the buffer/FIFO of the temporary memory 116 to synchronize with the external propagation total delay, the function block 117 performs clearing residual music signals to separate the sensing signal 210 of the headphone unit 110 diaphragm displacement and extracting the sensing signal 210 for subsequent analysis and reference source of automatic control and/or signal compensation.

Moreover, depending on actual needs, the signal processing system 1 of the present invention further comprises a first processing unit (not shown), wherein the first processing unit is for outputting the identified signal to the main controller, and the sensing signal 210 of the headphone unit 110 diaphragm extracted by the function block 117 is transmitted to the first processing unit for motion signal identification to determine the usage status of the headphone unit by the user, for example, putting on the headphone, taking of the headphone, or filter tapping the headphone shell. The first processing unit can output the identified signal to the main controller for human-machine interaction application. Alternatively, in actual application, the music related signals of the sensing signal 210 of the headphone unit 110 diaphragm extracted and separated by the block function 117 is sent to a second processing unit for low-pass filtering, and then phase-inversed and added to the original music digital stream data 115 to compensate the bass distortion of the headphone unit.

Figure 2:
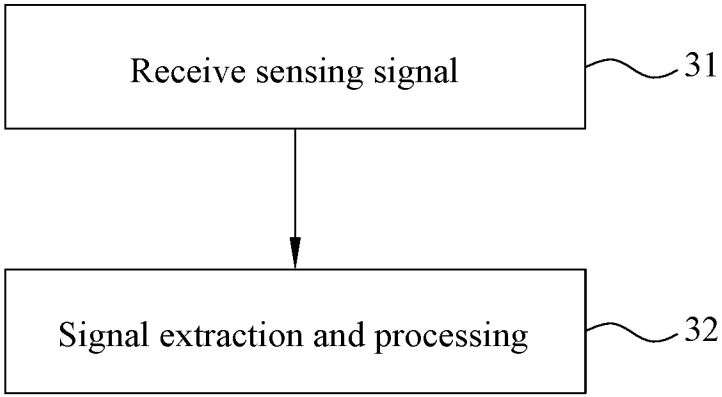
FIG. 2 shows a flowchart of the signal processing method used in the signal processing system in FIG. 1.

FIG. 2 is a flowcharting showing the steps of the signal processing method used by the signal processing system of FIG. 1.

As shown in FIG. 2, step 31 is to perform receiving the sensing signal. By using the headphone unit 110 diaphragm as a sensor, when the headphone unit 110 diaphragm connected to the signal processing system 1 of the present invention shows diaphragm displacement caused by the external force or non-ideal motion, a sensing signal 210 is generated and pushed back to the output end of the power amplifier 111 of the signal processing system 1. The operation then proceeds to step 32.

Step 32 is to perform the signal extraction and processing; wherein the sensing signal 210 of the headphone unit 110 passively induced is extracted while the headphone unit 110 playing the audio, and the extracted sensing signal 210 is used as the reference source for subsequent analysis and automatic control.

Moreover, depending on actual needs, when using the signal processing method, the signal processing system 1 of the present invention may further comprise a step of analyzing control motion or signal compensation; wherein the extracted sensing signal 210 is used as a reference source for subsequent analysis, and automatic control and/or signal compensation.

Accordingly, in the step of analyzing control motion, the sensing signal 210 of the headphone unit 110 diaphragm extracted by the function block 117 is transmitted to a first processing unit for motion signal identification to determine the usage status of the headphone unit by the user, for example, putting on the headphone, taking of the headphone, or filter tapping the headphone shell. The first processing unit can output the identified signal to the main controller for human-machine interaction application. Alternatively, in signal compensation step, the music related signals of the sensing signal 210 of the headphone unit 110 diaphragm extracted and separated by the block function 117 is sent to a second processing unit for low-pass filtering, and then phase-inversed and added to the original music digital stream data 115 to compensate the bass distortion of the headphone unit.

Figure 3:
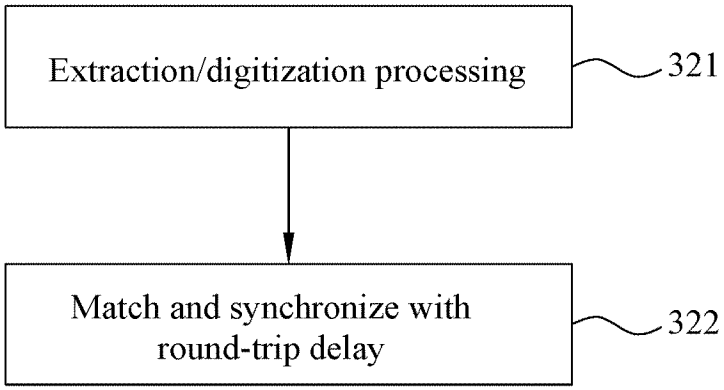
FIG. 3 shows a flowchart of detailed steps of the signal extraction and processing of the signal processing method in FIG. 2.

FIG. 3 shows a flowchart of detailed steps of the signal extraction and processing of the signal processing method in FIG. 2.

As shown in FIG. 3, step 321 is to perform extraction/digitization: during performing signal extraction, after the sensing signal 210 generated by the diaphragm displacement of the headphone unit 110 diaphragm caused by the external force and non-ideal motion is pushed back to the output end of the power amplifier 111, the differential amplifier 112 is used to extract the sensing signal 210 generated by the diaphragm and pushed back to the sense ADC 114 for digitization since the output end of the power amplifier 111 is connected to an input end of the differential amplifier 112, the output end of the audio DAC 113 is connected to the other input end of the differential amplifier 112, the sense ADC 114 is connected to the differential amplifier 112, and then proceeds to step 322.

Step 322 is to perform matching and synchronizing with the round-trip delay: because of the non-ideality of the differential amplifier 112 (CMRR is not without upper limit), there will still be a certain percentage of the residual original music signal, and to eliminate the residual original music signal for subsequent processing, the temporary memory 116 is additionally disposed to match and synchronize the original signal (music digital stream data 115) residual with a round-trip delay of the external signal starting from the audio DAC 113, through the power amplifier 111, the headphone unit 110, the differential amplifier 112 to the sense ADC 114.

Accordingly, during the matching and synchronizing with the round-trip delay, the round-trip delay is calculated according to the sample clock frequencies of the audio DAC 113 and the sense ADC 114, and the type of the filter to adjust and set the depth and the clock of the buffer/FIFO of the temporary memory 116 to synchronize with the external propagation total delay; then, after adjusting and setting the depth and the clock of the buffer/FIFO of the temporary memory 116 to synchronize with the external propagation total delay, the function block 117 performs clearing residual music signals to separate the sensing signal 210 of the headphone unit 110 diaphragm displacement and extracting the sensing signal 210 for subsequent analysis and reference source of automatic control and/or signal compensation.

Wherein, when matching and synchronizing the original signal residual with a round-trip delay of the external signal starting from the audio DAC 113, through the power amplifier 111, the headphone unit 110, the differential amplifier 112 to the sense ADC 114:

1. In the audio DAC 113: the internal over sample filter has a fixed delay linked to the sample clock, according to the features and specifications of finite impulse response (FIR) filter and the infinite impulse response (IIR) filter, the fixed delay is generally between tens of microsecond (μs) and a few millisecond (ms).

2. During the trip from the power amplifier 111 to the headphone unit 110 to the differential amplifier 112: the delay is mainly the parasitic and compensation RC delay of the linear amplifier, generally a few hundreds of nanoseconds.

3. In the sense ADC 114: the delay is the internal command input coupler (CIC) filter iterative computation delay, which is the multiplication of the over sample rate and the over sample clock, generally tens of μs.

The above three delays can be described by formula. After computing the round-trip delay based on the sample clock frequencies of the audio DAC 113 and the sense ADC 114, and the type of the filter used, and the result is used for adjusting and setting the depth and the clock of the buffer/FIFO of the temporary memory 116 to synchronize with the external propagation total delay, the function block 117 performs clearing residual music signals to separate the sensing signal 210 of the headphone unit 110 diaphragm displacement and extracting the sensing signal 210 for subsequent analysis and reference source of automatic control and/or signal compensation.

Figure 4:
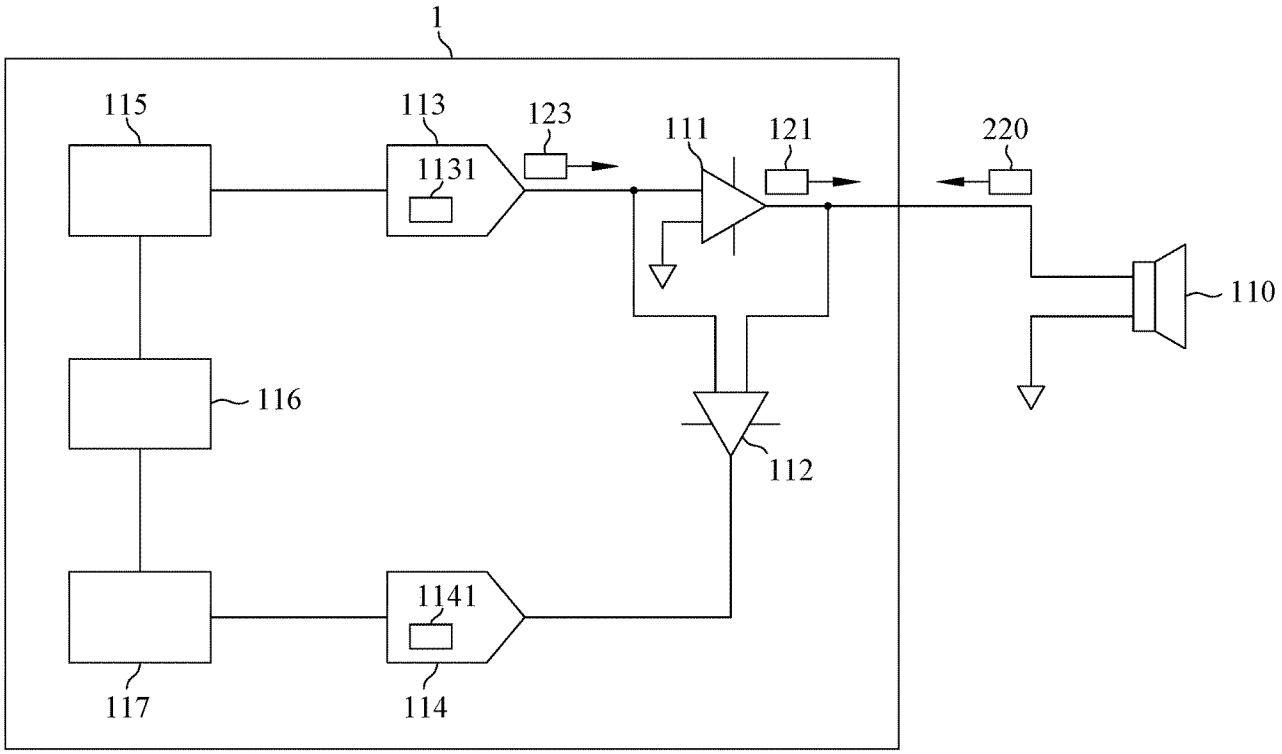
FIG. 4 shows a schematic view of an embodiment of the signal processing system and operation in collaboration with a headphone unit according to the present invention.

FIG. 4 is a schematic view showing an embodiment of the signal processing system of the present invention and the operation in collaboration with a headphone unit. As shown in FIG. 4, the signal processing system 1 comprises at least a power amplifier 111, a differential amplifier 112, an audio digital-to-analog converter (DAC) 113, a sense analog-to-digital converter (ADC) 114, a temporary memory 116 and a function block 117.

The audio DAC 113: an original music digital streaming data 115 is converted by the audio DAC 113 to an analog output 123.

The power amplifier 111: when the original music digital stream data 115 is converted by the audio DAC 113 to the analog output 123, the analog output 123 is sent to the power amplifier 111 for outputting the original music input signal 121 as the analog signal to the headphone unit 110 connected to the power amplifier 111; moreover, a sense signal 220 caused by the displacement of the diaphragm (not shown)

when the diaphragm of the headphone unit 110 is induced by the external force and the non-ideal motion will be pushed back to the output end of the power amplifier 111.

The differential amplifier 112: the output end of the power amplifier 111 is connected to an input end of the differential amplifier 112 and the output of the audio DAC 113 is connected to the other input end of the differential amplifier 112.

The sense ADC 114: the sense ADC 114 is connected to the output of the differential amplifier 112, and the sense signal 220 generated by the diaphragm is extracted by the differential amplifier 112 and pushed back to the sense ADC 114 for digitization.

The temporary memory 116: because of the non-ideality of the differential amplifier 112 (CMRR is not without upper limit), there will still be a certain percentage of the residual original music signal, and to eliminate the residual original music signal for subsequent processing, the temporary memory 116 is additionally disposed to match and synchronize the original signal residual (music digital stream data 115) with a round-trip delay of the external signal starting from the audio DAC 113, through the power amplifier 111, the headphone unit 110, the differential amplifier 112 to the sense ADC 114, the round-trip delay is calculated according to the sample clock frequencies of the audio DAC 113 and the sense ADC 114, and the type of the filter to adjust and set the depth and the clock of the buffer/FIFO of the temporary memory 116 to synchronize with the external propagation total delay.

The function block 117: the function block 117 is a headphone unit diaphragm displacement extraction module, for extracting the sensing signal generated by the headphone unit 110 diaphragm displacement; after adjusting and setting the depth and the clock of the buffer/FIFO of the temporary memory 116 to synchronize with the external propagation total delay, the function block 117 performs clearing residual music signals to separate the sensing signal 220 of the headphone unit 110 diaphragm displacement and extracting the sensing signal 220 for subsequent analysis and reference source of automatic control and/or signal compensation.

Wherein, when matching and synchronizing the original signal residual with a round-trip delay of the external signal starting from the audio DAC 113, through the power amplifier 111, the headphone unit 110, the differential amplifier 112 to the sense ADC 114:

1. In the audio DAC 113: the internal over sample filter 1131 has a fixed delay linked to the sample clock, according to the features and specifications of finite impulse response (FIR) filter and the infinite impulse response (IIR) filter, the fixed delay is generally between tens of microsecond (μs) and a few millisecond (ms).

2. During the trip from the power amplifier 111 to the headphone unit 110 to the differential amplifier 112: the delay is mainly the parasitic and compensation RC delay of the linear amplifier, generally a few hundreds of nanoseconds.

3. In the sense ADC 114: the delay is the internal command input coupler (CIC) filter 1141 iterative computation delay, which is the multiplication of the over sample rate and the over sample clock, generally tens of μs.

The above three delays can be described by formula. After computing the round-trip delay based on the sample clock frequencies of the audio DAC 113 and the sense ADC 114, and the type of the filter used, and the result is used for adjusting and setting the depth and the clock of the buffer/FIFO of the temporary memory 116 to synchronize with the external propagation total delay, the function block 117 performs clearing residual music signals to separate the sensing signal 220 of the headphone unit 110 diaphragm displacement and extracting the sensing signal 220 for subsequent analysis and reference source of automatic control and/or signal compensation.

Figure 5:
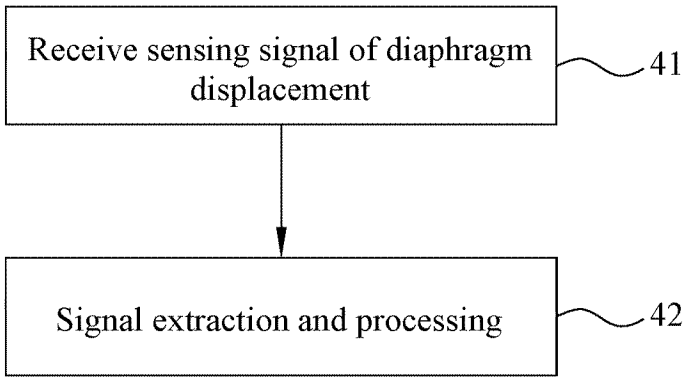
FIG. 5 shows a flowchart of the signal processing method used by the embodiment of the signal processing system of FIG. 4.

FIG. 5 is a flowcharting showing the steps of the signal processing method used by the signal processing system of FIG. 4.

As shown in FIG. 5, step 41 is to perform receiving the sensing signal. By using the headphone unit 110 diaphragm as a sensor, when the headphone unit 110 diaphragm connected to the signal processing system 1 of the present invention shows diaphragm displacement caused by the external force or non-ideal motion, a sensing signal 220 is generated and pushed back to the output end of the power amplifier 111 of the signal processing system 1. The operation then proceeds to step 42.

Step 42 is to perform the signal extraction and processing; wherein the sensing signal 220 of the headphone unit 110 passively induced is extracted while the headphone unit 110 playing the audio, and the extracted sensing signal 220 is used as the reference source for subsequent analysis and automatic control.

Figure 6:
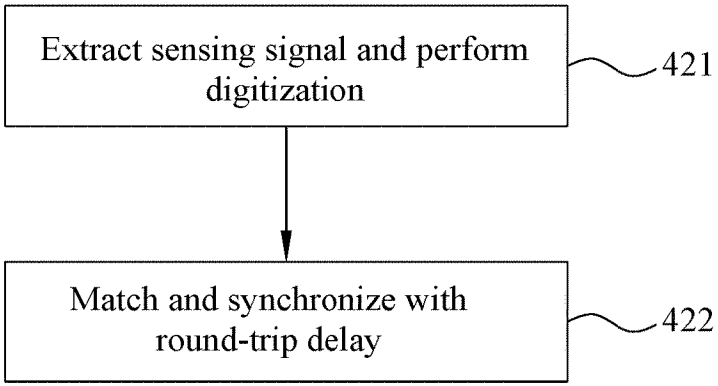
FIG. 6 shows a flowchart of detailed steps of the signal extraction and processing of the signal processing method in FIG. 5.

FIG. 6 shows a flowchart of detailed steps of the signal extraction and processing of the signal processing method in FIG. 5.

As shown in FIG. 6, step 421 is to perform extraction/digitization: during performing signal extraction, after the sensing signal 220 generated by the diaphragm displacement of the headphone unit 110 diaphragm caused by the external force and non-ideal motion is pushed back to the output end of the power amplifier 111, the differential amplifier 112 is used to extract the sensing signal 220 generated by the diaphragm and pushed back to the sense ADC 114 for digitization since the output end of the power amplifier 111 is connected to an input end of the differential amplifier 112, the output end of the audio DAC 113 is connected to the other input end of the differential amplifier 112, the sense ADC 114 is connected to the differential amplifier 112, and then proceeds to step 422.

Step 422 is to perform matching and synchronizing with the round-trip delay: because of the non-ideality of the differential amplifier 112 (CMRR is not without upper limit), there will still be a certain percentage of the residual original music signal, and to eliminate the residual original music signal for subsequent processing, the temporary memory 116 is additionally disposed to match and synchronize the original signal (music digital stream data 115) residual with a round-trip delay of the external signal starting from the audio DAC 113, through the power amplifier 111, the headphone unit 110, the differential amplifier 112 to the sense ADC 114.

Accordingly, during the matching and synchronizing with the round-trip delay, the round-trip delay is calculated according to the sample clock frequencies of the audio DAC 113 and the sense ADC 114, and the type of the filter to adjust and set the depth and the clock of the buffer/FIFO of the temporary memory 116 to synchronize with the external propagation total delay; then, after adjusting and setting the depth and the clock of the buffer/FIFO of the temporary memory 116 to synchronize with the external propagation total delay, the function block 117 performs clearing residual music signals to separate the sensing signal 220 of the headphone unit 110 diaphragm displacement and extracting the sensing signal 220 for subsequent analysis and reference source of automatic control and/or signal compensation.

Wherein, when matching and synchronizing the original signal residual with a round-trip delay of the external signal starting from the audio DAC 113, through the power amplifier 111, the headphone unit 110, the differential amplifier 112 to the sense ADC 114:

1. In the audio DAC 113: the internal over sample filter 1131 has a fixed delay linked to the sample clock, according to the features and specifications of finite impulse response (FIR) filter and the infinite impulse response (IIR) filter, the fixed delay is generally between tens of microsecond (μs) and a few millisecond (ms).

2. During the trip from the power amplifier 111 to the headphone unit 110 to the differential amplifier 112: the delay is mainly the parasitic and compensation RC delay of the linear amplifier, generally a few hundreds of nanoseconds.

3. In the sense ADC 114: the delay is the internal command input coupler (CIC) filter 1141 iterative computation delay, which is the multiplication of the over sample rate and the over sample clock, generally tens of μs.

The above three delays can be described by formula. After computing the round-trip delay based on the sample clock frequencies of the audio DAC 113 and the sense ADC 114, and the type of the filter used, and the result is used for adjusting and setting the depth and the clock of the buffer/FIFO of the temporary memory 116 to synchronize with the external propagation total delay, the function block 117 performs clearing residual music signals to separate the sensing signal 220 of the headphone unit 110 diaphragm displacement and extracting the sensing signal 220 for subsequent analysis and reference source of automatic control and/or signal compensation.

Figure 7:
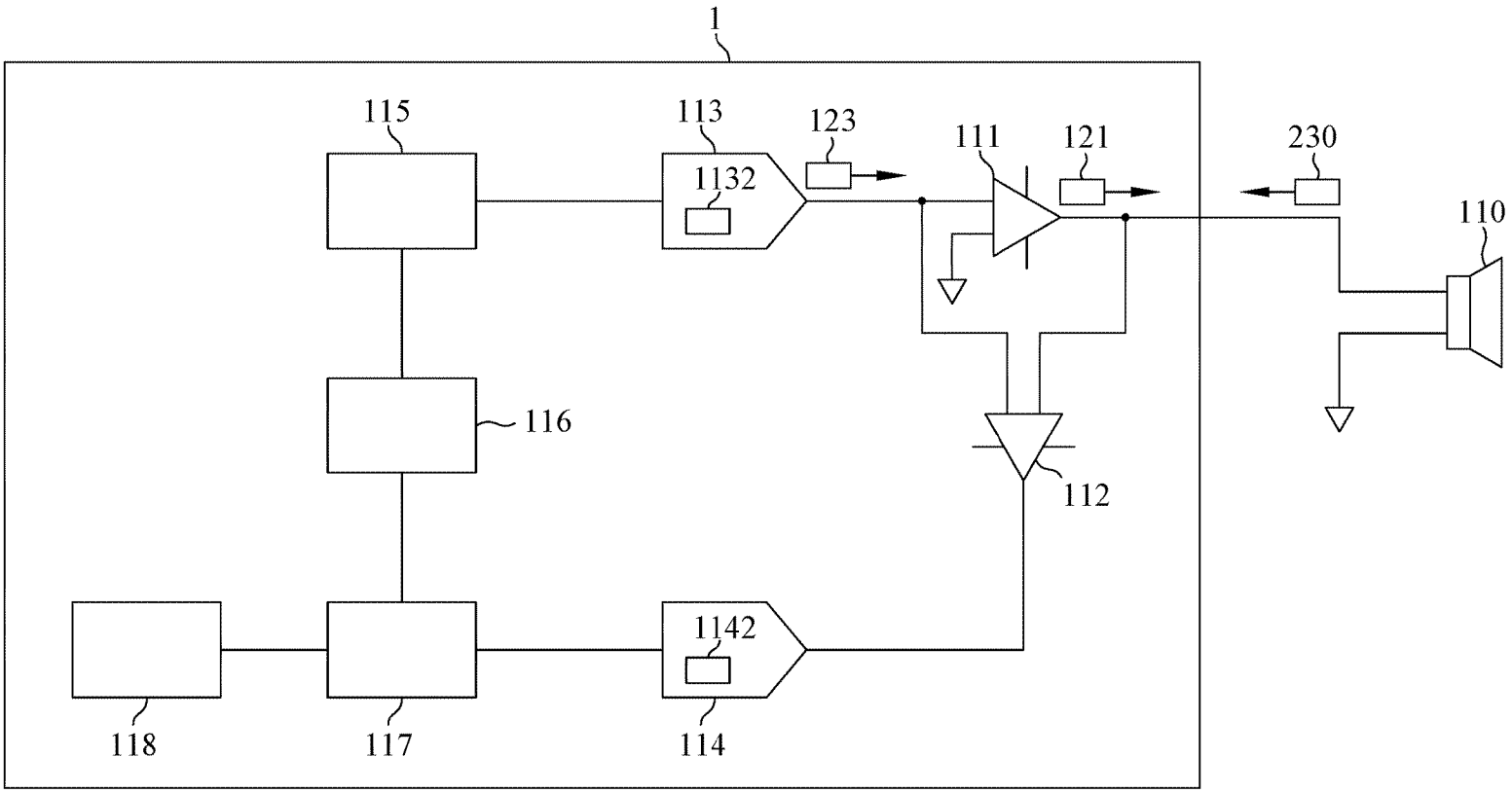
FIG. 7 shows a schematic view of another embodiment of the signal processing system and operation in collaboration with a headphone unit according to the present invention.

FIG. 7 is a schematic view showing another embodiment of the signal processing system of the present invention and the operation in collaboration with a headphone unit. As shown in FIG. 7, the signal processing system 1 comprises at least a power amplifier 111, a differential amplifier 112, an audio digital-to-analog converter (DAC) 113, a sense analog-to-digital converter (ADC) 114, a temporary memory 116, a function block 117 and a first processing unit 118.

The audio DAC 113: an original music digital streaming data 115 is converted by the audio DAC 113 to an analog output 123.

The power amplifier 111: when the original music digital stream data 115 is converted by the audio DAC 113 to the analog output 123, the analog output 123 is sent to the power amplifier 111 for outputting the original music input signal 121 as the analog signal to the headphone unit 110 connected to the power amplifier 111; moreover, a sense signal 230 caused by the displacement of the diaphragm (not shown) when the diaphragm of the headphone unit 110 is induced by the external force and the non-ideal motion will be pushed back to the output end of the power amplifier 111.

The differential amplifier 112: the output end of the power amplifier 111 is connected to an input end of the differential amplifier 112 and the output of the audio DAC 113 is connected to the other input end of the differential amplifier 112.

The sense ADC 114: the sense ADC 114 is connected to the output of the differential amplifier 112, and the sense signal 230 generated by the diaphragm is extracted by the differential amplifier 112 and pushed back to the sense ADC 114 for digitization.

The temporary memory 116: because of the non-ideality of the differential amplifier 112 (CMRR is not without upper limit), there will still be a certain percentage of the residual original music signal, and to eliminate the residual original music signal for subsequent processing, the temporary memory 116 is additionally disposed to match and synchronize the original signal residual (music digital stream data 115) with a round-trip delay of the external signal starting from the audio DAC 113, through the power amplifier 111, the headphone unit 110, the differential amplifier 112 to the sense ADC 114, the round-trip delay is calculated according to the sample clock frequencies of the audio DAC 113 and the sense ADC 114, and the type of the filter to adjust and set the depth and the clock of the buffer/FIFO of the temporary memory 116 to synchronize with the external propagation total delay.

The function block 117: the function block 117 is a headphone unit diaphragm displacement extraction module, for extracting the sensing signal 230 generated by the headphone unit 110 diaphragm displacement; after adjusting and setting the depth and the clock of the buffer/FIFO of the temporary memory 116 to synchronize with the external propagation total delay, the function block 117 performs clearing residual music signals to separate the sensing signal 230 of the headphone unit 110 diaphragm displacement and extracting the sensing signal 230 for subsequent analysis and reference source of automatic control and/or signal compensation.

Wherein, when matching and synchronizing the original signal residual with a round-trip delay of the external signal starting from the audio DAC 113, through the power amplifier 111, the headphone unit 110, the differential amplifier 112 to the sense ADC 114:

1. In the audio DAC 113: the internal over sample filter 1132 has a fixed delay linked to the sample clock, according to the features and specifications of finite impulse response (FIR) filter and the infinite impulse response (IIR) filter, the fixed delay is generally between tens of microsecond (μs) and a few millisecond (ms).

2. During the trip from the power amplifier 111 to the headphone unit 110 to the differential amplifier 112: the delay is mainly the parasitic and compensation RC delay of the linear amplifier, generally a few hundreds of nanoseconds.

3. In the sense ADC 114: the delay is the internal command input coupler (CIC) filter 1142 iterative computation delay, which is the multiplication of the over sample rate and the over sample clock, generally tens of μs.

The above three delays can be described by formula. After computing the round-trip delay based on the sample clock frequencies of the audio DAC 113 and the sense ADC 114, and the type of the filter used, and the result is used for adjusting and setting the depth and the clock of the buffer/FIFO of the temporary memory 116 to synchronize with the external propagation total delay, the function block 117 performs clearing residual music signals to separate the sensing signal 230 of the headphone unit 110 diaphragm displacement and extracting the sensing signal 230 for subsequent analysis and reference source of automatic control and/or signal compensation.

The first processing unit 118: the first processing unit 118 is for outputting the identified signal to the main controller, and the sensing signal 230 of the headphone unit 110 diaphragm extracted by the function block 117 is transmitted to the first processing unit 118 for motion signal identification to determine the usage status of the headphone unit 110 by the user, for example, putting on the headphone, taking of the headphone, or filter tapping the headphone shell. The first processing unit 118 can output the identified signal to the main controller for human-machine interaction application.

Figure 8:
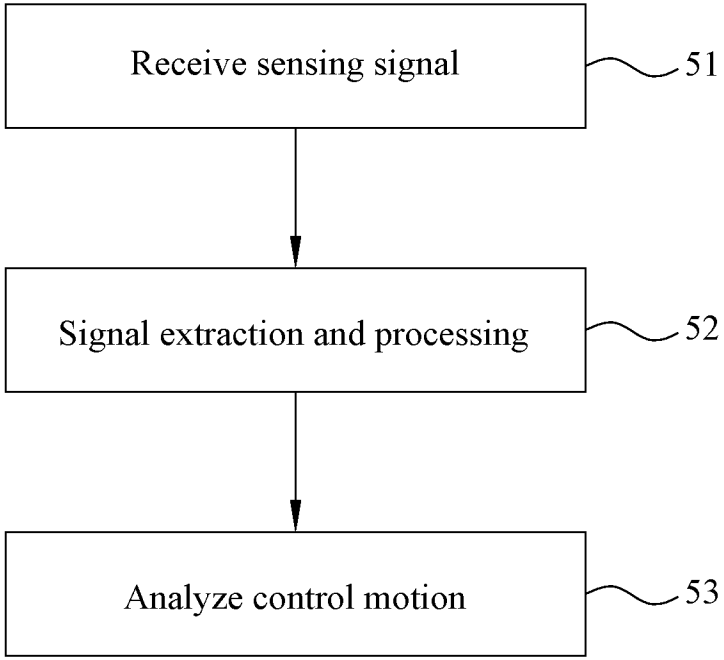
FIG. 8 shows a flowchart of the signal processing method used by the embodiment of the signal processing system of FIG. 7.

FIG. 8 is a flowcharting showing the steps of the signal processing method used by the signal processing system of FIG. 7.

As shown in FIG. 8, step 51 is to perform receiving the sensing signal. By using the headphone unit 110 diaphragm as a sensor, when the headphone unit 110 diaphragm connected to the signal processing system 1 of the present invention shows diaphragm displacement caused by the external force or non-ideal motion, a sensing signal 230 is generated and pushed back to the output end of the power amplifier 111 of the signal processing system 1. The operation then proceeds to step 52.

Step 52 is to perform the signal extraction and processing; wherein the sensing signal 230 of the headphone unit 110 passively induced is extracted while the headphone unit 110 playing the audio, and the extracted sensing signal 230 is used as the reference source for subsequent analysis and automatic control, then proceeds to step 53.

Step 53 is to perform analyzing the control motion: the sensing signal 230 of the headphone unit 110 diaphragm extracted by the function block 117 is transmitted to a first processing unit for motion signal identification to determine the usage status of the headphone unit by the user, for example, putting on the headphone, taking of the headphone, or filter tapping the headphone shell. The first processing unit can output the identified signal to the main controller for human-machine interaction application.

Figure 9:
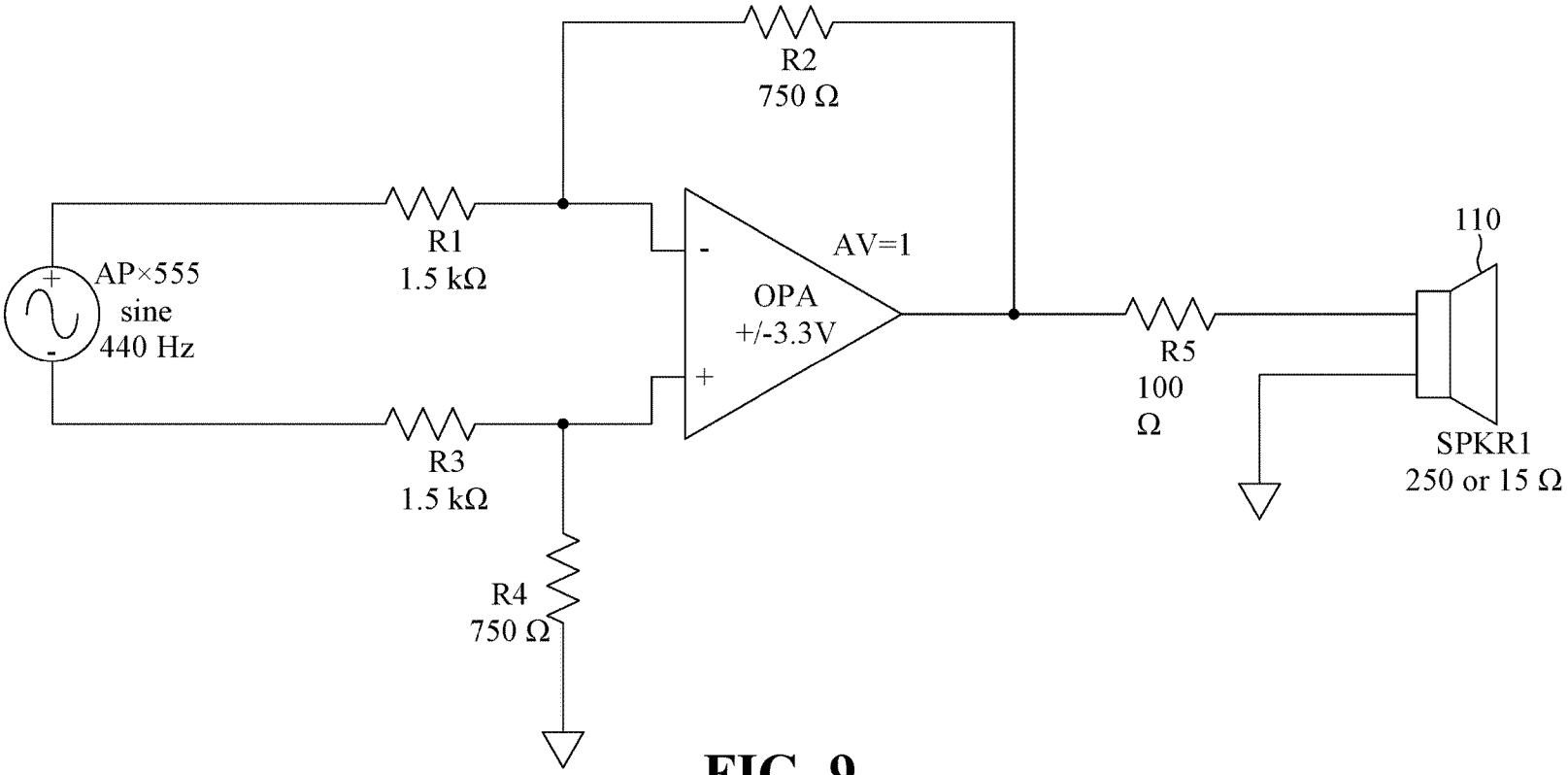
FIG. 9 shows a schematic circuit view of the signal processing system of FIG. 7, comprising: power amplifier, differential amplifier, sense ADC, and a portion of the headphone unit.

FIG. 9 is a diagram for describing a portion of the circuit of the power amplifier, differential amplifier, sense ADC and the headphone unit of the signal processing system of FIG. 7.

As shown in FIG. 9, the headphone unit 110 SPKR1 has a impedance of 15 or 25Ω, AV1 amplifier +/−3.3V, the voltage signal source APx555 balance output sine 440 Hz, amplitude is 100 mv, R1 is 1.5KΩ, R2 is 750Ω, R3 is 1.5KΩ, R4 is 750Ω, and R5 is 100Ω; at the connection of r1 and R2, R5 and headphone unit 110, the APx55 balance input high-pass: AC (<10 Hz), low-pass: 800 Hz.

The circuit of FIG. 9 can also be used in other embodiments, and the operation is similar to the embodiment of FIG. 7.

Figures 1, 10:
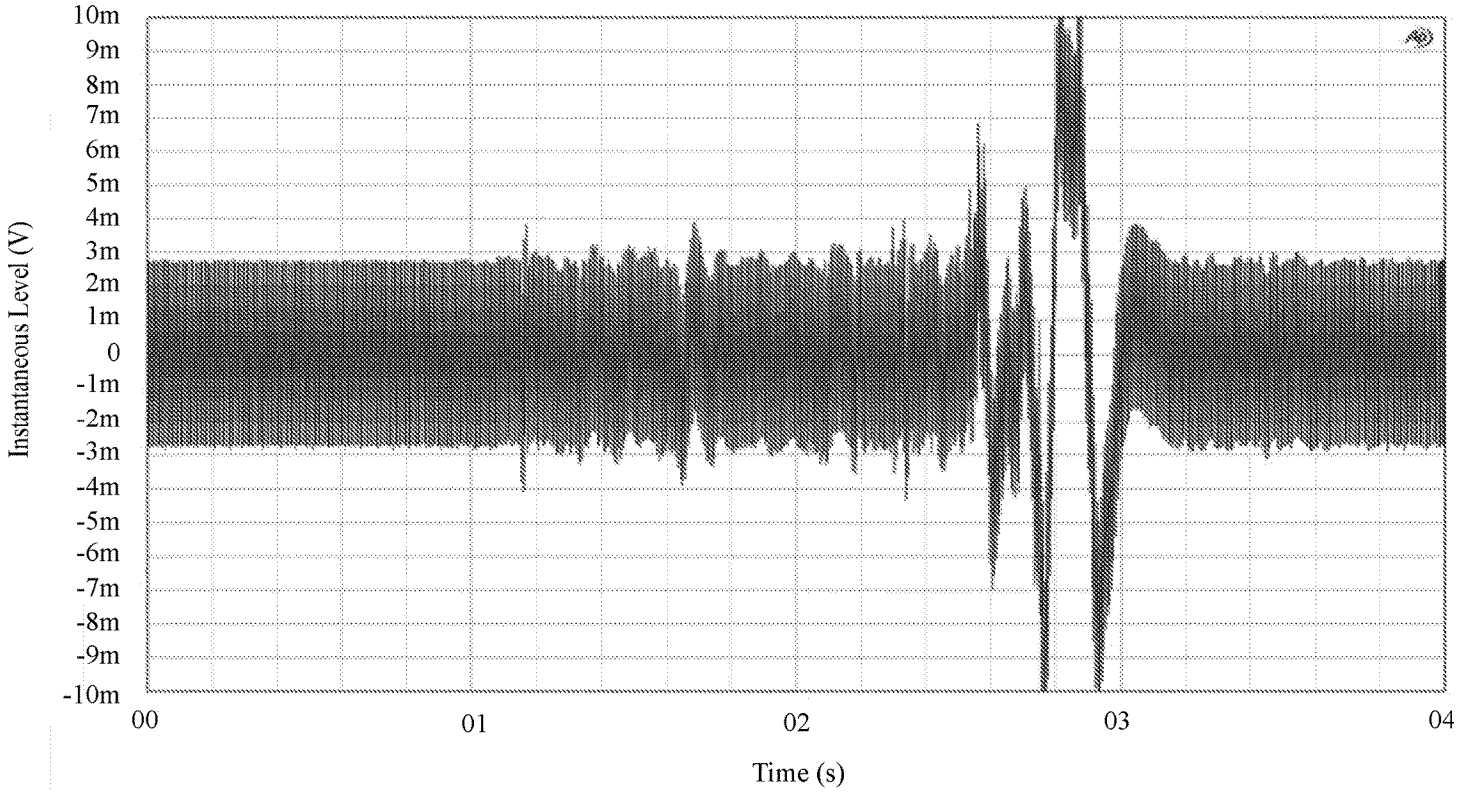
Figures 2, 10:
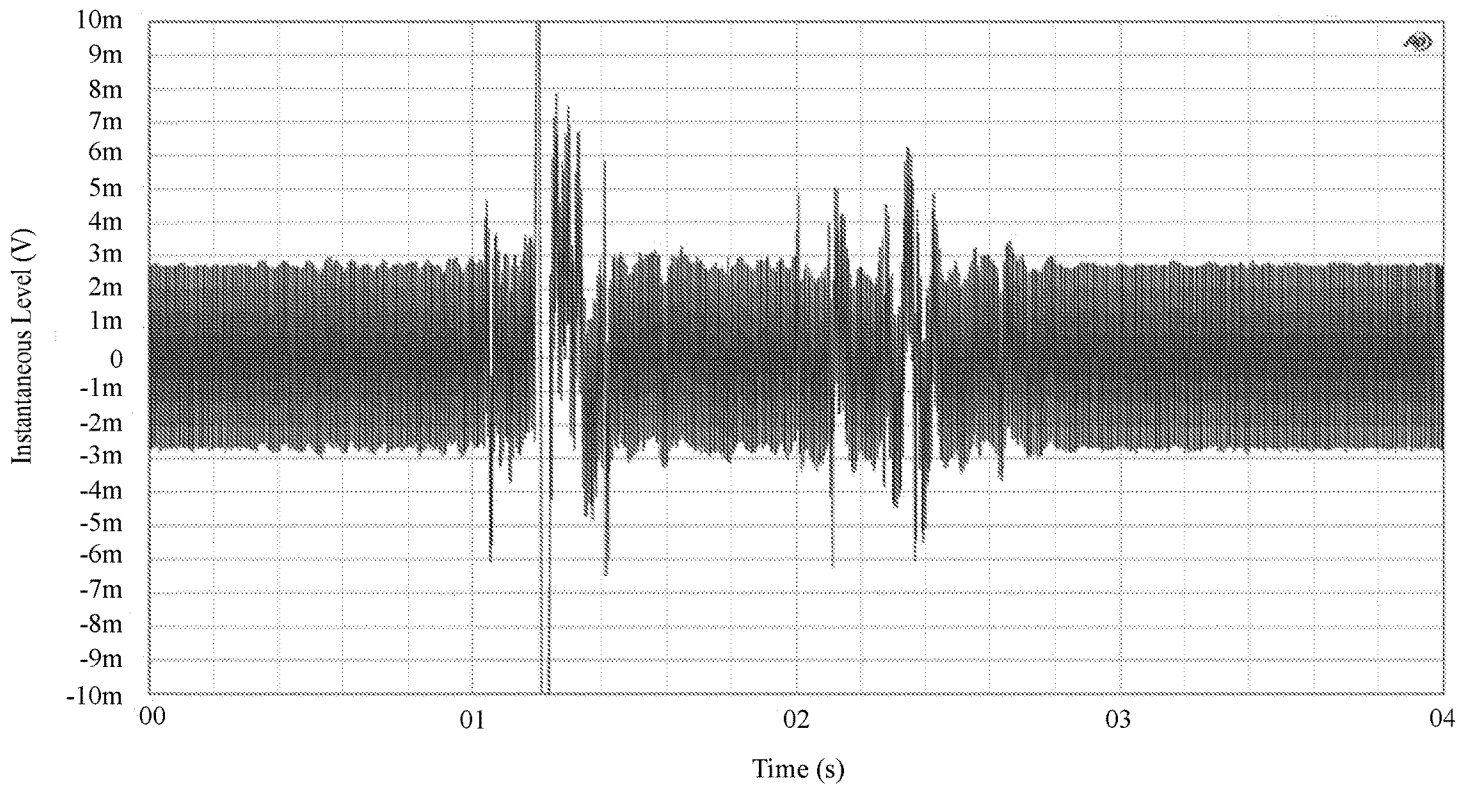
Figures 3, 10:
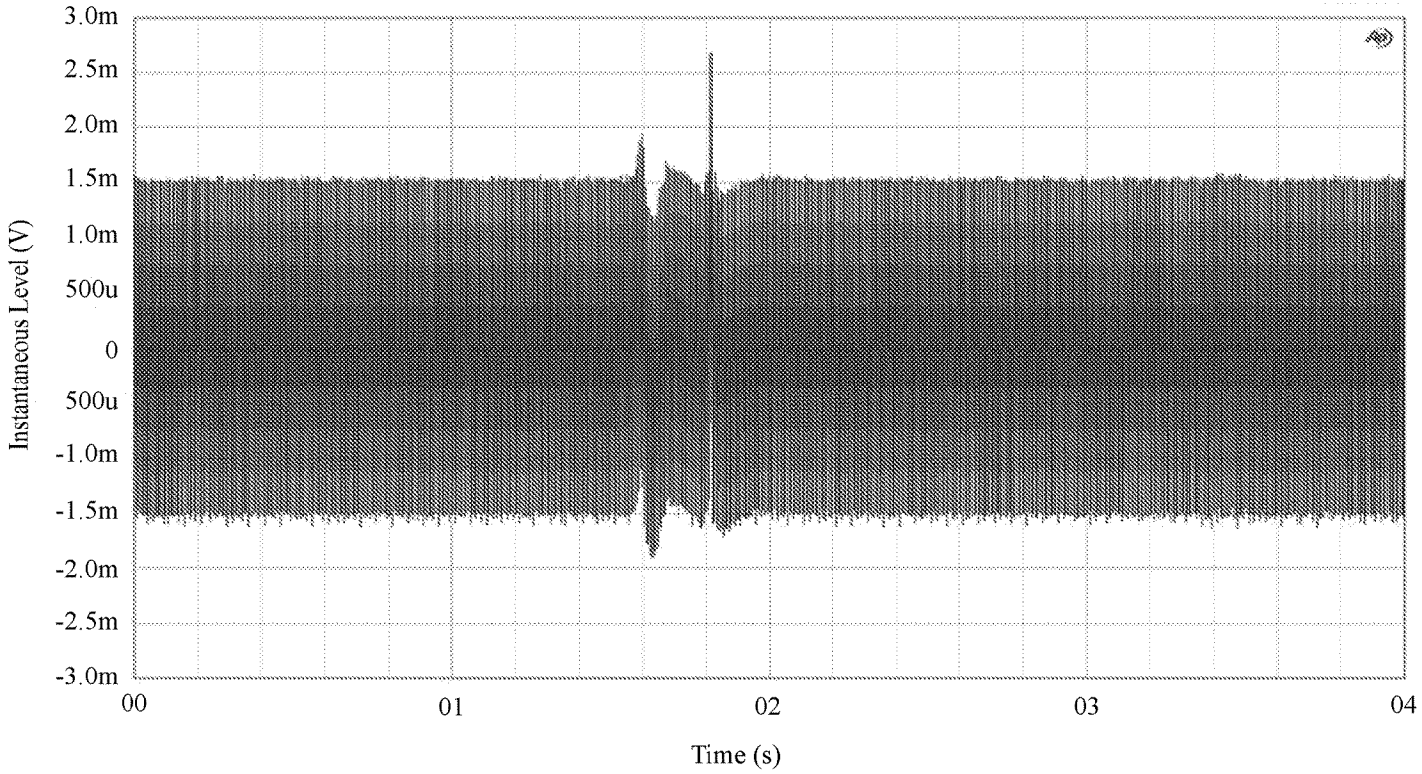
Figures 4, 10:
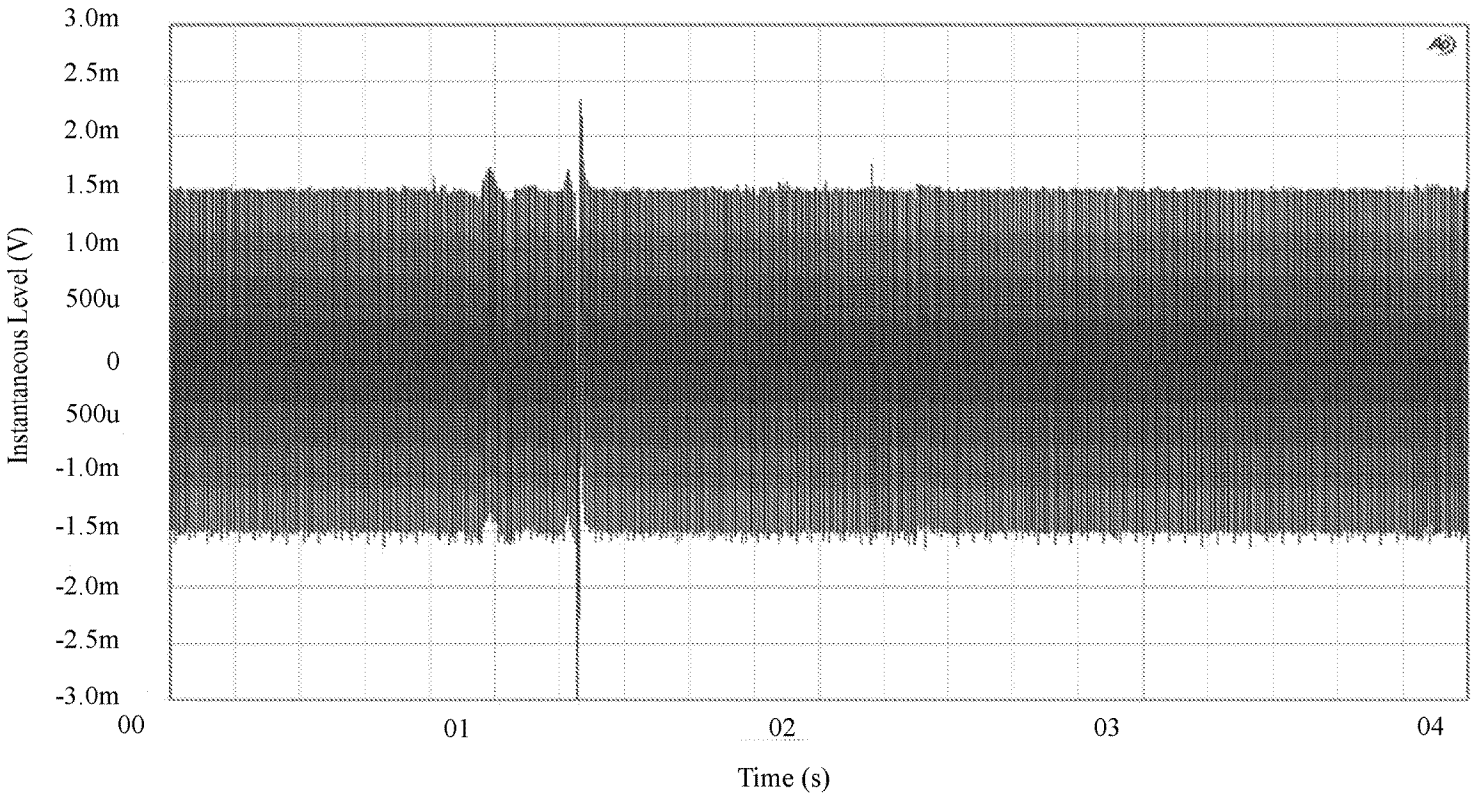

FIG. 10-1 shows a schematic view of sensing signal output of the headphone unit diaphragm when the user putting on the earmuff headphone of FIG. 7.

As shown in FIG. 10-1, the sensing signal output of the headphone unit 110 diaphragm when the user putting on the earmuff headphone shows that an instantaneous level change in the sensing signal within 2-3 seconds after the user puts on the headphone.

FIG. 10-2 shows a schematic view of sensing signal output of the headphone unit diaphragm when the user taking off the earmuff headphone of FIG. 7.

As shown in FIG. 10-2, the sensing signal output of the headphone unit 110 diaphragm when the user taking off the earmuff headphone shows that an instantaneous level change in the sensing signal when the user takes off the headphone.

FIG. 10-3 shows a schematic view of sensing signal output of the headphone unit diaphragm when the user putting on the in-ear headphone of FIG. 7.

As shown in FIG. 10-3, the sensing signal output of the headphone unit 110 diaphragm when the user putting on the in-ear headphone shows that an instantaneous level change in the sensing signal within 1-2 seconds after the user puts on the headphone.

FIG. 10-4 shows a schematic view of sensing signal output of the headphone unit diaphragm when the user taking off the in-ear headphone of FIG. 7.

As shown in FIG. 10-4, the sensing signal output of the headphone unit 110 diaphragm when the user taking off the in-ear headphone shows that an instantaneous level change in the sensing signal when the user takes off the headphone.

Figure 11:
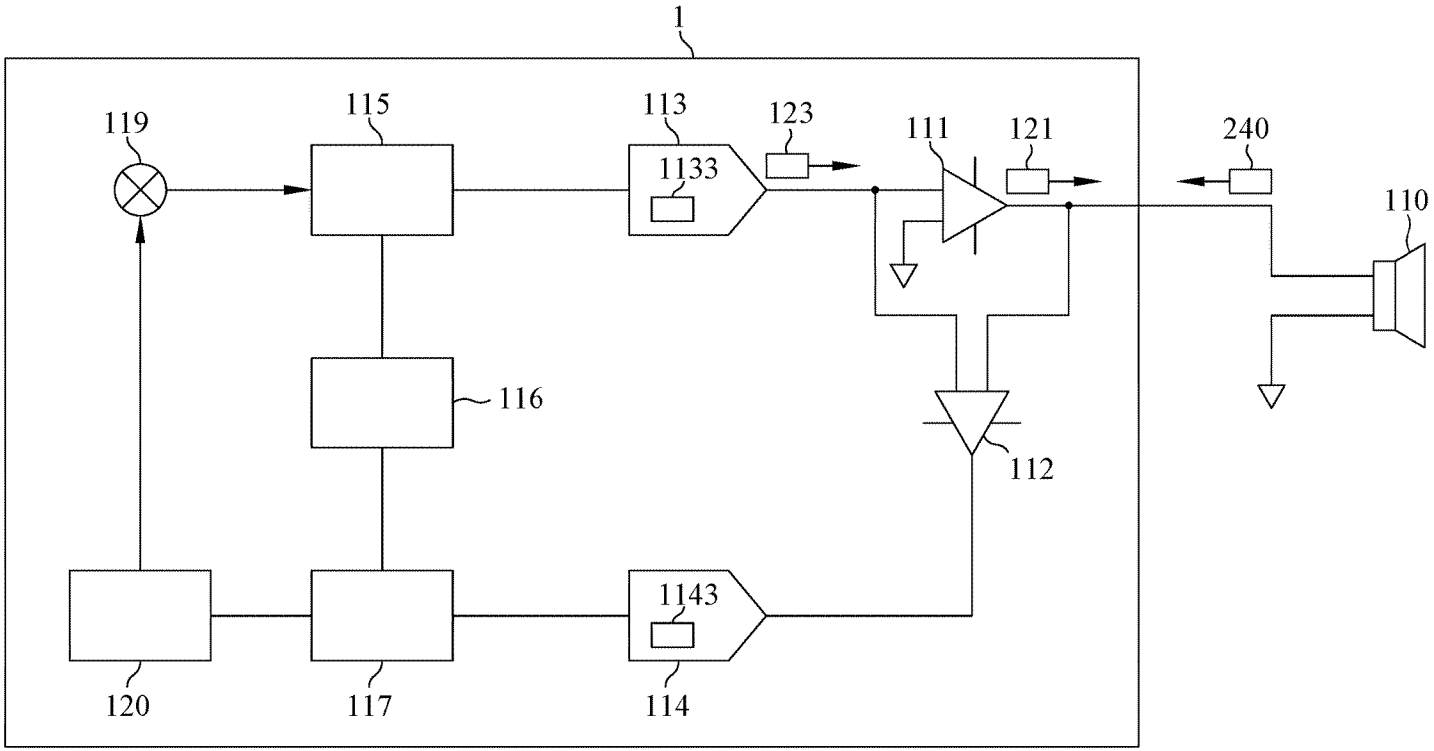
FIG. 11 is a schematic view of yet another embodiment of the signal processing system and operation in collaboration with a headphone unit according to the present invention.

FIG. 11 is a schematic view showing yet another embodiment of the signal processing system of the present invention and the operation in collaboration with a headphone unit. As shown in FIG. 11, the signal processing system 1 comprises at least a power amplifier 111, a differential amplifier 112, an audio digital-to-analog converter (DAC) 113, a sense analog-to-digital converter (ADC) 114, a temporary memory 116, a function block 117 and a second processing unit 120.

The audio DAC 113: an original music digital streaming data 115 is converted by the audio DAC 113 to an analog output 123.

The power amplifier 111: when the original music digital stream data 115 is converted by the audio DAC 113 to the analog output 123, the analog output 123 is sent to the power amplifier 111 for outputting the original music input signal 121 as the analog signal to the headphone unit 110 connected to the power amplifier 111; moreover, a sense signal 240 caused by the displacement of the diaphragm (not shown) when the diaphragm of the headphone unit 110 is induced by the external force and the non-ideal motion will be pushed back to the output end of the power amplifier 111.

The differential amplifier 112: the output end of the power amplifier 111 is connected to an input end of the differential amplifier 112 and the output of the audio DAC 113 is connected to the other input end of the differential amplifier 112.

The sense ADC 114: the sense ADC 114 is connected to the output of the differential amplifier 112, and the sense signal 240 generated by the diaphragm is extracted by the differential amplifier 112 and pushed back to the sense ADC 114 for digitization.

The temporary memory 116: because of the non-ideality of the differential amplifier 112 (CMRR is not without upper limit), there will still be a certain percentage of the residual original music signal, and to eliminate the residual original music signal for subsequent processing, the temporary memory 116 is additionally disposed to match and synchronize the original signal residual (music digital stream data 115) with a round-trip delay of the external signal starting from the audio DAC 113, through the power amplifier 111, the headphone unit 110, the differential amplifier 112 to the sense ADC 114, the round-trip delay is calculated according to the sample clock frequencies of the audio DAC 113 and the sense ADC 114, and the type of the filter to adjust and set the depth and the clock of the buffer/FIFO of the temporary memory 116 to synchronize with the external propagation total delay.

The function block 117: the function block 117 is a headphone unit diaphragm displacement extraction module, for extracting the sensing signal 240 generated by the headphone unit 110 diaphragm displacement; after adjusting and setting the depth and the clock of the buffer/FIFO of the temporary memory 116 to synchronize with the external propagation total delay, the function block 117 performs clearing residual music signals to separate the sensing signal 240 of the headphone unit 110 diaphragm displacement and extracting the sensing signal 240 for subsequent analysis and reference source of automatic control and/or signal compensation.

Wherein, when matching and synchronizing the original signal residual with a round-trip delay of the external signal starting from the audio DAC 113, through the power amplifier 111, the headphone unit 110, the differential amplifier 112 to the sense ADC 114:

1. In the audio DAC 113: the internal over sample filter 1133 has a fixed delay linked to the sample clock, according to the features and specifications of finite impulse response (FIR) filter and the infinite impulse response (IIR) filter, the fixed delay is generally between tens of microsecond (μs) and a few millisecond (ms).

2. During the trip from the power amplifier 111 to the headphone unit 110 to the differential amplifier 112: the delay is mainly the parasitic and compensation RC delay of the linear amplifier, generally a few hundreds of nanoseconds.

3. In the sense ADC 114: the delay is the internal command input coupler (CIC) filter 1143 iterative computation delay, which is the multiplication of the over sample rate and the over sample clock, generally tens of μs.

The above three delays can be described by formula. After computing the round-trip delay based on the sample clock frequencies of the audio DAC 113 and the sense ADC 114, and the type of the filter used, and the result is used for adjusting and setting the depth and the clock of the buffer/FIFO of the temporary memory 116 to synchronize with the external propagation total delay, the function block 117 performs clearing residual music signals to separate the sensing signal 240 of the headphone unit 110 diaphragm displacement and extracting the sensing signal 240 for subsequent analysis and reference source of automatic control and/or signal compensation.

The second processing unit 120: the second processing unit 120 is for signal compensation; the music related signals of the sensing signal 240 of the headphone unit 110 diaphragm extracted and separated by the block function 117 is sent to the second processing unit 120 for low-pass filtering, and then phase-inversed and added to 119 the original music digital stream data 115 to compensate the bass distortion of the headphone unit 110.

Figure 12:
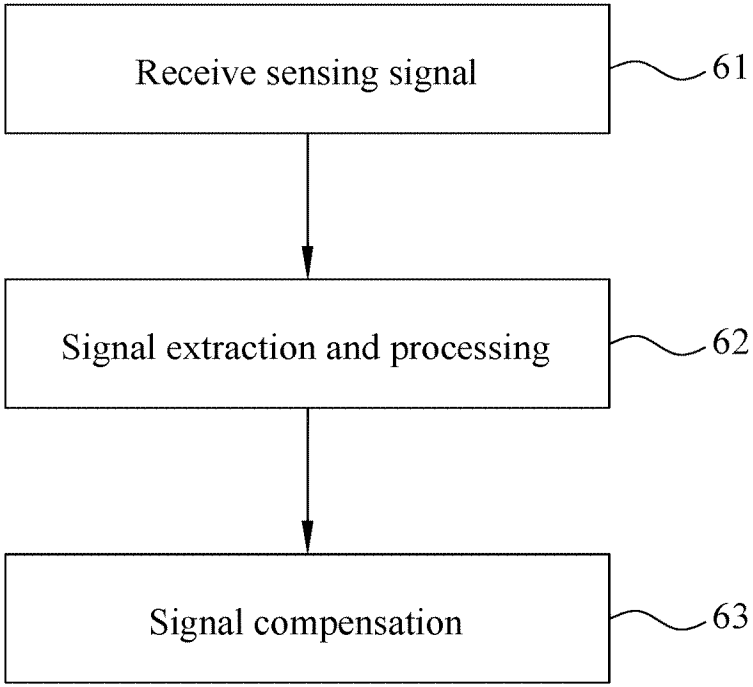
FIG. 12 shows a flowchart of the signal processing method used by the embodiment of the signal processing system of FIG. 11.

FIG. 12 is a flowcharting showing the steps of the signal processing method used by the signal processing system of FIG. 8.

As shown in FIG. 12, step 61 is to perform receiving the sensing signal. By using the headphone unit 110 diaphragm as a sensor, when the headphone unit 110 diaphragm connected to the signal processing system 1 of the present invention shows diaphragm displacement caused by the external force or non-ideal motion, a sensing signal 240 is generated and pushed back to the output end of the power amplifier 111 of the signal processing system 1. The operation then proceeds to step 62.

Step 62 is to perform the signal extraction and processing; wherein the sensing signal 240 of the headphone unit 110 passively induced is extracted while the headphone unit 110 playing the audio, and the extracted sensing signal 240 is used as the reference source for subsequent analysis and automatic control, then proceeds to step 63.

Step 63 is to perform signal extraction and processing: the music related signals of the sensing signal 240 of the headphone unit 110 diaphragm extracted and separated by the block function 117 is sent to the second processing unit 120 for low-pass filtering, and then phase-inversed and added to 119 the original music digital stream data 115 to compensate the bass distortion of the headphone unit 110.

In summary, the signal processing system and method of the present invention is applicable to an environment of signal separation application with a headphone driver unit diaphragm used as a sensor. The signal processing system of the present invention uses a differential amplifier to extract the sensed signals associated with the headphones wear status generated by the diaphragm of the headphone and push back to the sense ADC for digitization. Because the differential amplifier is non-ideal (CMRR is not no limit), a certain percentage of residual music signal will exist. To exclude residual music signal for subsequent processing, an additional temporary memory is provided to match and synchronize the original playback signal retainment and the round-trip delay of external signal. The round-trip delay is computed according to the sample clock of the audio DAC and sense ADC and the type of selected filter, to adjust the depth and clock speed of the buffer/FIFO of the temporary memory so as to, after synchronized with the total external propagation delay, eliminate residual music signal in a function block in order to separate the sense signal of the headphone driver unit diaphragm displacement and use the extracted sense signal for subsequent analysis and auto-control and/or signal compensation reference source. The present invention provides the following advantages:

Without adding additional headphone material (BOM), using the headphone driver unit diaphragm as a sensor to extract the sensing signal generated by the headphone unit diaphragm while the headphone unit playing the audio and use the extracted sensing signal for subsequent analysis and reference source for automatic control and/or signal compensation.

In an environment of signal separation application with a headphone driver unit diaphragm used as a sensor, using a differential amplifier to extract the sensed signals associated with the headphones wear status generated by the diaphragm of the headphone and push back to the sense ADC for digitization. Because the differential amplifier is non-ideal (CMRR is not no limit), a certain percentage of residual music signal will exist. To exclude residual music signal for subsequent processing, an additional temporary memory is provided to match and synchronize the original playback signal retainment and the round-trip delay of external signal. The round-trip delay is computed according to the sample clock of the audio DAC and sense ADC and the type of selected filter, to adjust the depth and clock speed of the buffer/FIFO of the temporary memory so as to, after synchronized with the total external propagation delay, eliminate residual music signal in a function block in order to separate the sense signal of the headphone driver unit diaphragm displacement and use the extracted sense signal for subsequent analysis and auto-control and/or signal compensation reference source.

In an environment of signal separation application with a headphone driver unit diaphragm used as a sensor, by analyzing the headphone wear status to save the additional cable for headphone sensor to sense the donned and doffed status. For example, when the headphone is a status of being removed from one ear, the playback of music is automatically paused to facilitate the conversation; in a status of being removed from both ears, the playback/cellphone is automatically in a sleep mode; when the headphone is worn in one ear, the phone is automatically answered; and when wearing on two ears without in-coming phone call, the music paused earlier is automatically resumed.

In an environment of signal separation application with a headphone driver unit diaphragm used as a sensor, by analyzing the headphone wear status; without adding additional headphone material (BOM), a tapping on the headphone shell can be used to replace button interface, such as, for play/pause/answer/hang-up/skip song/and volume adjustment.

In an environment of signal separation application with a headphone driver unit diaphragm used as a sensor, by analyzing the headphone wear status; without adding additional headphone material (BOM), a back electromotive force generated by the overdrive displacement of the headphone driver unit diaphragm can be detected in real-time to compensate the motion distortion of the driver unit diaphragm and improve the audio quality of low-cost headphone driver unit and reduce the output to protect the driver unit from burning caused by excessive back electromotive force.

It will be apparent to those skilled in the art that various modifications and variations can be made to the disclosed embodiments. It is intended that the specification and examples be considered as exemplary only, with a true scope of the disclosure being indicated by the following claims and their equivalents.

What is claimed is:

1. A signal processing system, applicable to an environment of a signal separation application using a headphone unit diaphragm of a headphone unit as a sensor, comprising:

a power amplifier, receiving a sensing signal from the headphone unit, wherein the headphone unit diaphragm is used as a sensor, a sensing signal is caused by the displacement of the headphone unit diaphragm when the headphone unit diaphragm is induced by an external force and a non-ideal motion, and the sensing signal is pushed back to an output end of the power amplifier;

an audio digital-to-analog converter (DAC), for converting an original music digital stream data into an analog output; wherein the original music digital stream data is converted by the audio DAC to the analog output, the analog output is sent to the power amplifier for outputting the original music digital stream data as an analog signal to the headphone unit;

a differential amplifier, the output end of the power amplifier being connected to one input end of the differential amplifier and the analog output of the audio DAC being connected to the other input end of the differential amplifier;

a sense analog-to-digital converter (ADC), the sense ADC being connected to an output end of the differential amplifier, and the sensing signal generated by the headphone unit diaphragm being extracted by the differential amplifier and pushed back to the sense ADC for digitization;

a temporary memory, matching and synchronizing residual from the original music digital stream data with a round-trip delay of an external signal starting from the audio DAC, through the power amplifier, the headphone unit, the differential amplifier to the sense ADC; wherein the round-trip delay is calculated according to sample clock frequencies of the audio DAC and the sense ADC, and the type of a filter to adjust and set depth and clock of an buffer/FIFO of the temporary memory to synchronize with an external propagation total delay; and a function block, the function block being a headphone unit diaphragm displacement extraction module, for extracting the sensing signal generated by the headphone unit diaphragm displacement; after adjusting and setting the depth and the clock of the buffer/FIFO of the temporary memory to synchronize with the external propagation total delay, the function block performing clearing residual music signals to separate the sensing signal of the headphone unit diaphragm displacement and extracting the sensing signal for subsequent analysis and reference source of automatic control and/or signal compensation.

2. The signal processing system as claimed in claim 1, wherein for using the extracted sensing signal as a reference source of subsequent analysis and automatic control, the system further comprises:

a first processing unit, wherein the sensing signal of the headphone unit diaphragm extracted by the function block is transmitted to the first processing unit for motion signal identification to determine the usage status of the headphone unit by a user, and an identified signal is sent a main controller for human-machine interaction application.

3. The signal processing system as claimed in claim 1, wherein for using the extracted sensing signal as a reference source of signal compensation, the system further comprises:

a second processing unit, wherein the sensing signal of the headphone unit diaphragm being extracted and separated by the block function is sent to the second processing unit for low-pass filtering, and then phase-inversed and added to the original music digital stream data to compensate for bass distortion of the headphone unit.

4. The signal processing system as claimed in claim 1, wherein an internal over sample filter of the audio DAC has a fixed delay linked to a sample clock.

5. The signal processing system as claimed in claim 1, wherein an internal command input coupler filter of the sense ADC iteratively computes the round-trip delay.

* * * * *